US009764805B2

(12) United States Patent
Miles

(10) Patent No.: US 9,764,805 B2
(45) Date of Patent: Sep. 19, 2017

(54) BOARD

(71) Applicant: Nick Miles, Freshwater (AU)

(72) Inventor: Nick Miles, Freshwater (AU)

( * ) Notice: Subject to any disclaimer, the term of this patent is extended or adjusted under 35 U.S.C. 154(b) by 0 days.

(21) Appl. No.: 14/286,096

(22) Filed: May 23, 2014

(65) Prior Publication Data

US 2014/0364023 A1 Dec. 11, 2014

(30) Foreign Application Priority Data

Jun. 6, 2013 (AU) ..... 2013206203

(51) Int. Cl.
*B63B 35/81* (2006.01)
*A63C 5/03* (2006.01)
*B63B 35/79* (2006.01)

(52) U.S. Cl.
CPC ..... *B63B 35/7906* (2013.01); *B63B 35/7909* (2013.01); *Y10T 29/49801* (2015.01)

(58) Field of Classification Search
CPC . B63B 35/79; B63B 35/7906; B63B 35/7909; B63B 35/7916; B63B 2035/79; B63B 35/7903; Y10T 29/49801
USPC ..... 114/65, 74
See application file for complete search history.

(56) References Cited

U.S. PATENT DOCUMENTS

| | | | | |
|---|---|---|---|---|
| 5,921,833 | A | 7/1999 | Bixby | |
| 5,944,570 | A * | 8/1999 | Appleby | B63B 35/7906 441/65 |
| 6,800,006 | B1 * | 10/2004 | Itnyre | B63B 35/7909 114/357 |
| 7,985,111 | B2 | 7/2011 | Gasparro | |
| 2007/0145638 | A9 * | 6/2007 | Mead | B29C 33/307 264/272.15 |
| 2009/0280704 | A1 * | 11/2009 | Fort | B63B 35/7906 441/74 |
| 2010/0240271 | A1 * | 9/2010 | Mann | B63B 35/7906 441/74 |
| 2012/0263916 | A1 | 10/2012 | Green et al. | |
| 2014/0364023 | A1 * | 12/2014 | Miles | B63B 35/7906 441/74 |

FOREIGN PATENT DOCUMENTS

| | | | |
|---|---|---|---|
| AU | 2011226976 | B2 | 4/2013 |
| WO | WO8202866 | A1 | 9/1982 |
| WO | WO2012062973 | A1 | 5/2012 |

* cited by examiner

*Primary Examiner* — Daniel V Venne
(74) *Attorney, Agent, or Firm* — Kilpatrick Townsend & Stockton LLP

(57) ABSTRACT

A surfboard core and a stringer array embedded in the core to modify handling characteristics of the board.

4 Claims, 4 Drawing Sheets

BOARD

FIELD OF THE INVENTION

The present invention relates to a surfboard and, in particular, to reinforcement of the surfboard.

BACKGROUND OF THE INVENTION

It is known to provide a single reinforcing timber rib down the centre of a surfboard. The surfboard is formed from a blank that is cut in half lengthwise of the board. The rib is set between the two halves which are then bonded back together and fiber glassed.

The rib is arranged in a vertical configuration and provides rigidity and additional strength to the board along the centre line, where a surfer's feet are placed. However, any flexing of the board, such as while riding a wave, generates a twist around the rib and through the length of the board, which can adversely effect performance.

Another form of reinforcement is to place carbon fiber strips along rails of the board and fiber glass over the rails during the final production phase of the board. The reinforced rails provide increased strength along the sides of the board but not at the ends of the board and, importantly, not where the surfer's feet are usually placed.

Another disadvantage of the side rail reinforcement is that carbon fiber can be damaged during production, shaping and handling of the core before the fiber glass is applied and that can compromise the strength of the reinforcement.

OBJECT OF THE INVENTION

The present invention seeks to provide an improved surfboard core and method of making a surfboard core.

SUMMARY OF THE INVENTION

In accordance with the invention, there is provided a board core and a stringer array embedded in the core to modify handling characteristics of the board, the array including stringers that extend lengthwise of the core, either side of a centre line of the core, wherein: each stringer extends between a nose and tail of the core and includes a generally straight section, through a middle part of the board where a rider's feet would normally be located, and a curved section at either end of the generally straight section that curves outwardly away from the centre line and terminates at a side edge of the core; and wherein the stringers incorporate a twisted profile through parts of the core where enhanced flex is required.

Preferably, the array includes a plurality of stringers extending lengthwise of the core.

Preferably, the stringers are arranged to either side of a centre line of the core.

Preferably, the stringers are symmetrically arranged about the centre line.

Preferably, the stringers are formed of carbon fiber strips. In one aspect, the stringers are formed from woven carbon fibre material.

Preferably, the stringers include a vertical profile, in a direction normal to a riding surface of the core, at locations where a surfer's feet would normally be positioned when riding the board, in order to enhance rigidity and strength of the core at those locations.

In another aspect, there is provided a surfboard including a core, as described above.

In another aspect, there is provided a method of forming a surfboard core including: providing core sections with profiled matching edges; bonding stringers to associated ones of the edges; joining the core sections together whereby to form a core with an embedded stringer array, wherein: each stringer extends between a nose and tail of the core and includes a generally straight section, through a middle part of the board where a rider's feet would normally be located, and a curved section at either end of the generally straight section that curves outwardly away from the centre line and terminates at a side edge of the core; and wherein the stringers incorporate a twisted profile through parts of the core where enhanced flex is required.

Preferably, the core sections are provided in the form of a centre section, and two side sections.

BRIEF DESCRIPTION OF THE DRAWINGS

The invention is described, by way of non-limiting example only, with reference to the accompanying drawings, in which.

DETAILED DESCRIPTION OF THE INVENTION

Figure 1:
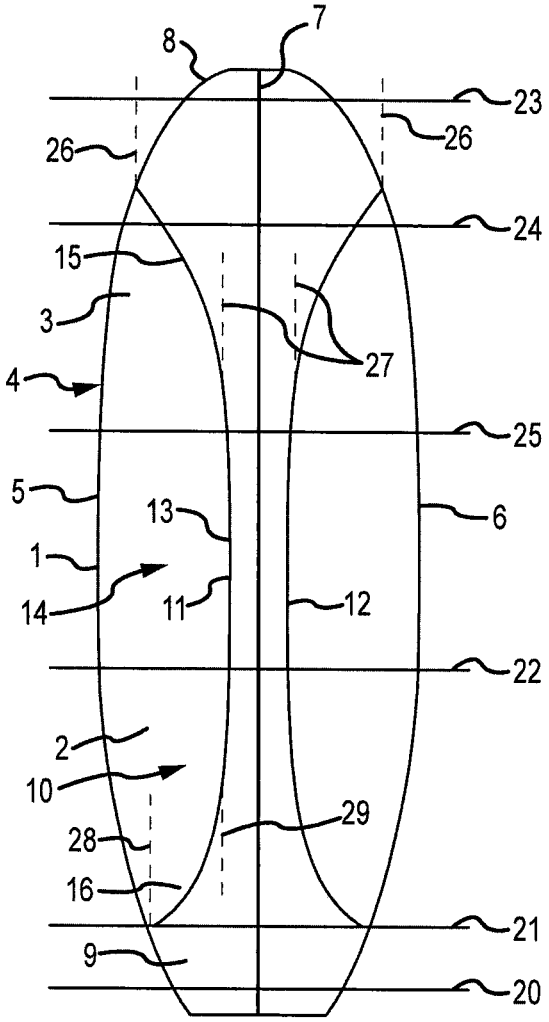
FIG. 1 is a plan view of a surfboard.

Referring firstly to FIG. 1, a surfboard 1 is shown that has a solid core 2 with a top surface 3 and a bottom surface 4 that meet at edges 5, 6. A centre line 7 runs longitudinally between nose 8 and tail 9 of the board 1.

The surfboard 1 has a stringer array 10 embedded in the core 2. The array 10 is formed of two elongate stringers 11, 12, each formed of a carbon fiber strip, although any other suitable material may be used.

One of the stingers 11 extends between the nose 8 and the tail 9, with a straight section 13 though a middle part 14 of the surfboard 1 where a surfer's feet would normally be located. The stringer 11 has curved end sections 15, 16 that terminate toward the side edge 5 of the board 1.

The other stringer 12 is embedded in the core 2, on an opposite side of the centre line.7 The stringer 12 has a mirror image configuration to the other stringer 11.

The surfboard 1, with the stringer array 10 has superior strength and rigidity through the middle part 14 of the board 1, and allows for a degree of flex at the nose 8 and tail 9 of the board 1. When the tail 9 flexes, the curved sections 15, 16 of the opposed stringers ensure there is minimal twist in the board 1, which provides for enhanced handling.

Additional line markings are shown in FIG. 1 that are, in use, applied to a board blank to assist in cutting the board blank at the initial stages of manufacturing the board. Line 20 is located close to the tail 9 and line 21 is positioned about 152 mm along the surfboard 1 up the centre line 7. Line 22 is located about 614 mm up the centre line 7. Similarly, line 23 is located at the head 8 with line 24 located about 152 mm down the centre line 7 and line 25 is located about 614 mm down the centre line 7. The stingers 11, 12 are then arrayed to curve between a point 185 mm from the centre line 7 on line 26 and a point 52 mm from the centre line 7 on line 27. Similarly, the stingers 11, 12 curve between a point about 95 mm from the center line 7 on line 28 and a point about 52 mm from the centre line 7 on line 29. The curved sections 15, 16 are connected by the straight sections 13 between lines 28 and 29. These measurements are indicative only and may be varied significantly while remaining within the scope of the invention.

The dimensions described may be used on a range of surfboard sizes simply by changing the length of the middle section where the stringers are straight. In this way, larger surfboards, typically used by heavier people, will have added strength due to the increased length of the stringers. Changing the strength and flexibility requirements of the surfboard may, however, be achieved by altering the dimensions given of the profile of the stingers 11, 12 running through the core 2, as described with reference to FIGS. 2 to 4

Figure 2A:
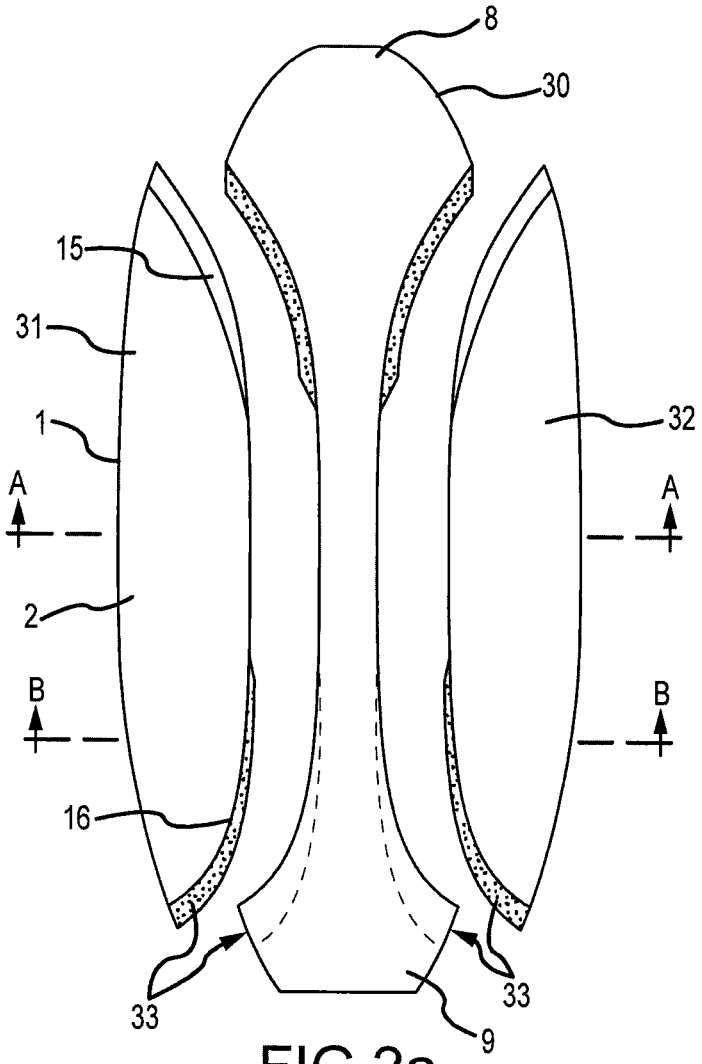
FIG. 2*a* is an exploded plan view of the surfboard core.

Referring to FIG. 2*a*, the core 2 of the surfboard 1 is shown in an exploded, pre-assembled condition. The core 2 is formed of a center part 30 and two side parts 31, 32 that each have profiled edges 33 that fit together in the finished product. To manufacture the core 2, the parts 31, 32 are machined with the appropriate profiles and strips of carbon fiber (not shown) are bonded to one of the associated edges 33, after which all the parts 30, 31, 32 are joined together and fiber glass applied over the top.

In this instance, the edges 33 are formed with a twisted or curved profile through the curved sections 15, 16 so that the edges 33 present a helix type twist from the nose 8 to the tail 9 of the core 2. The profile is substantially vertical though the straight sections 13, in a direction normal to a riding surface of the core 2, so as to impart maximum strength to the core 2 at the locations where a surfer's feet are normally positioned.

Figure 2B:
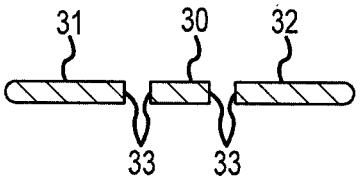
FIG. 2*b* is a cross-section view, taken along the line A-A shown in FIG. 2*a;*
Figure 2C:
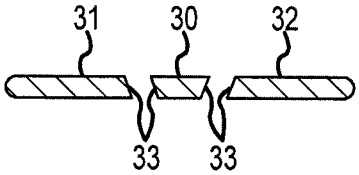
FIG. 2*c* is a cross-section view, taken along the line B-B shown in FIG. 2*a;*

FIGS. 2*b* and 2*c* illustrate cross-sectional views, taken along lines A-A and B-B respectively, to more clearly show the profiles of the relevant parts 30, 31, 32.

As may be appreciated, the helix configuration of the stringers 11, 12 extending lengthwise of the board will provide a spring-like quality to the board 1 which can be utilized to extract enhanced power and drive from the board 1, especially the tail 9 of the board 1.

Figure 3A:
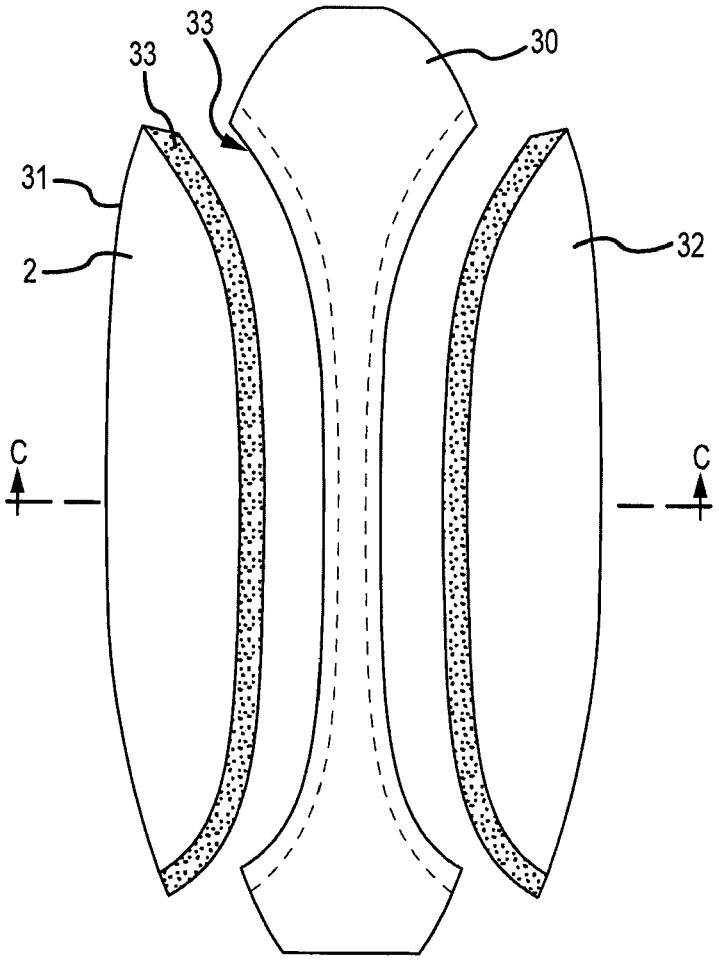
FIG. 3*a* is an exploded plan view of another surfboard core.
Figure 3B:
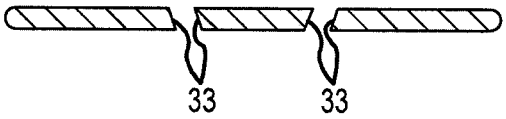
FIG. 3*b* is a cross-section view taken along the line C-C shown in FIG. 3*a;*

Referring now to FIG. 3*a*, another example of a core 2 is illustrated, where the profiled edges 33 are angled at about 45 degrees to the vertical. The angle of the edges 33 is shown more clearly in cross-section in FIG. 3*b*. The stingers 11, 12 embedded in the core 2 will have the same general configuration as shown in FIG. 1, however, the stingers 11, 12 will be offset by a predetermined angle relative to the vertical, instead of having a curved, twisted or helix profile. The angled profile will provide different handling characteristics to the core 2.

Figure 4A:
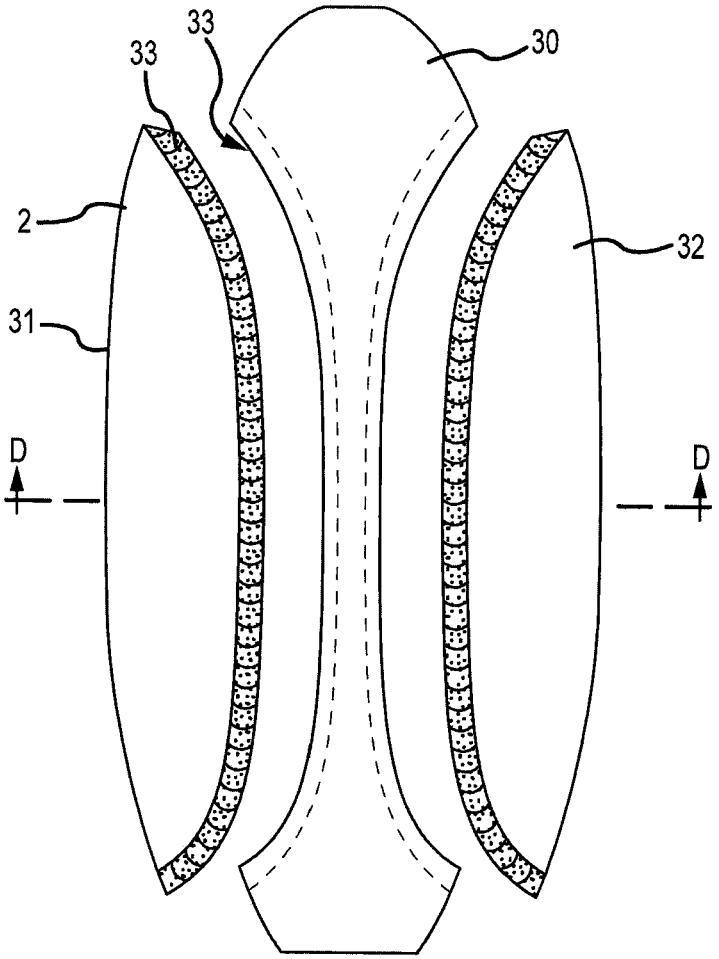
FIG. 4*a* is an exploded plan view of another surfboard core.
Figure 4B:
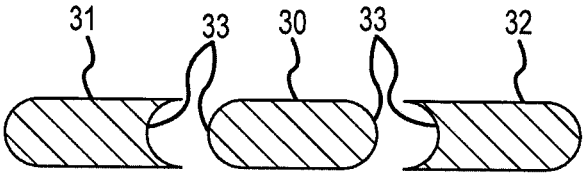
FIG. 4*b* is a cross-section view taken along the line D-D, shown in FIG. 4*a*.

Referring now to FIG. 4*a*, another example of a core 2 is shown. In this case, the matching profiled edges 33 have generally the same layout through the core 2, however, the edges 33 have a curved cross section, as more clearly shown in FIG. 4*b*. Again, the change in profile, will affect the handling characteristics of the core 2 and resultant surfboard.

As may be appreciated, the specific profile of the stringers 11, 12 and the layout can be varied to suit the required handling characteristics of the surfboard. More stringers can be used in the array and the profile of the stringers adjusted, as required.

Throughout the description, reference has been made to use on the invention in relation to a surfboard. However, for the purposes of the above description and the following claims, use of the word "surfboard" is to be taken as meaning any form of ride on board, such as a paddle board or the like.

Also, the stringers have been described as being formed of carbon fiber strips. However, the stringers may be formed of any suitable material such as Kevlar, metal or some form of composite material. The stringers need not necessarily extend the length of the board, as long as some degree of reinforcement and or preferred load transfer characteristics are satisfied.

It should also be appreciated the invention has been described by way of non-limiting example only and many modifications and variations may be made thereto without departing form the spirit and scope of the invention described.

LIST OF PARTS

1. Surfboard
2. Core
3. Top surface
4. Bottom surface
5. Edge
6. Edge
7. Centre line
8. Nose
9. Tail
10. Array
11. Stringer
12. Stringer
13. Straight section
14. Middle part
15. Curved section
16. Curved section
17.
18.
19.
20. Line
21. Line
22. Line
23. Line
24. Line
25. Line
26. Line
27. Line
28. Line
29. Line
30. Center part
31. Side part
32. Side part
33. Edge

The invention claimed is:

1. A board core and a stringer array embedded in the board core to modify handling characteristics of the board core, the stringer array including stringers that extend lengthwise of the board core, either side of a center line of the board core, wherein:

each of the stringers extends between a nose and a tail of the board core and includes a generally straight section, through a middle part of the board core where a rider's feet would normally be located, and a curved section that flares outwardly at either end of the generally straight section and away from the center line to terminate at a side edge of the board core; and wherein the board core comprises a center part and two side parts that each have one or more profiled edges that are joined together to form the board core;

each of the profiled edges extends between a top surface and a bottom surface of the board core;

the stringers are carbon fiber strips;

each of the stringers is bonded to associated ones of the profiled edges; and at least a portion of each stringer is embedded at an angle relative to vertical.

2. The board core of claim 1, wherein:

the stringers are symmetrically arranged about the center line.

3. The board core of claim 1, wherein:

the stringers include a vertical profile, in a direction normal to a riding surface of the board core, at locations where a rider's feet would normally be positioned when riding the board core, in order to enhance rigidity and strength of the board core at those locations.

4. The board core of claim 1, wherein:

the profiled edges are formed with a twisted or curved profile through the curved sections of the stringers so that the profiled edges present a helix twist from the nose to the tail; and the stringers have a helix configuration extending lengthwise of a surfboard that comprises the board core.

* * * * *